United States Patent [19]

Beard et al.

[11] Patent Number: 4,839,050

[45] Date of Patent: Jun. 13, 1989

[54] SKIMMER SYSTEM

[76] Inventors: Harold J. Beard; Raleigh L. Cox, both of 11328 Pennywood Ave., Baton Rouge, La. 70809-4138

[21] Appl. No.: 59,739

[22] Filed: Jun. 8, 1987

Related U.S. Application Data

[63] Continuation of Ser. No. 732,578, May 10, 1985, abandoned.

[51] Int. Cl.[4] ..... C02F 3/12; C02F 1/40; B01D 21/24

[52] U.S. Cl. ..... 210/540; 210/194; 210/195.1; 210/926

[58] Field of Search ..... 210/521, 522, 538, 540, 210/923, 926, 242.3, 194, 776, 195.1, 195.3

[56] References Cited

U.S. PATENT DOCUMENTS

| | | | |
|---|---|---|---|
| 3,886,064 | 5/1975 | Kosonen | 210/522 |
| 3,890,234 | 6/1975 | Galicia | 210/923 |
| 4,362,625 | 12/1982 | Beard | 210/521 |
| 4,372,854 | 2/1983 | Szereday | 210/923 |
| 4,382,922 | 5/1983 | Beard | 210/521 |
| 4,383,922 | 5/1983 | Beard | 210/521 |
| 4,392,957 | 7/1983 | Webb | 210/923 |
| 4,457,844 | 7/1984 | Beard | 210/624 |
| 4,614,589 | 9/1986 | Weis | 210/538 |

*Primary Examiner*—Benoit Castel

*Attorney, Agent, or Firm*—Robert C. Tucker; William D. Kiesel; Timothy J. Monahan

[57] ABSTRACT

A skimmer system is provided for structures having a floor, two side walls and at least one open end, the structure being semi-submersibly positionable in a moving liquid stream. The skimmer system comprises at least one side trough having a bottom, an interior trough wall and an exterior trough wall. The exterior trough wall is coincident with the interior side of one side wall of the structure and is provided with at least one opening communicating betweeen the interior of the trough and the exterior of the structure. The interior trough wall is provided with at least one opening communicating between the interior of the trough and the interior of the structure.

7 Claims, 2 Drawing Sheets

SKIMMER SYSTEM

This a a continuation of co-pending application Ser. No. 732,578 filed on May 10, 1985.

BACKGROUND OF THE INVENTION

1. Field of the Invention

This invention relates generally to devices which skim the surface of a liquid, and, more particularly, to devices which skim the surface of a moving stream of liquid.

2. Prior Art

There are many different devices which are employed to skim the surface of a liquid for various reasons. Many chemical and food processes require surface skimming. Additionally, various requirements exist for the skimming of water surfaces. The surface of a moving stream or lake is often skimmed to remove floating matter such as oil, scum or various solid floating objects. Skimming is also required in various sewage treatment processes to remove floating matter which cannot be removed by other chemical or physical clarification methods in the overall sewage treatment process.

In oxidation ditch sewage clarification systems, intrachannel clarifiers are often employed. Examples of an intrachannel clarifier may be seen in applicant's U.S. Pat. Nos. 4,362,625; 4,383,922 and 4,457,844. Applicant's clarifier functions by utilizing the hydraulic head losses created by a moving stream of sewage as it passes around and under a stationary semi-submerged structure. Various methods have been used to remove floating matter from the clarified liquid leaving the clarifier. These include a series of baffles or mechanical skimming devices which move across the liquid surface. Baffles tend to disrupt and disturb the flow within the clarifier. Mechanical skimmers require frequent maintenance and consume energy, increasing system costs. One type of skimmer may be seen in applicant's U.S. Pat. No. 4,436,632, which utilizes a float controlled skimming device.

SUMMARY OF INVENTION

Therefore, it is an object of this invention to provide a skimmer system which utilizes hydraulic head differential to skim floating matter from a moving liquid stream. It is another object of this invention to provide such a skimmer system which does not require additional mechanical skimming equipment in order to operate.

It is yet another object of this invention to provide such a skimmer system which may be adjusted in order to balance the hydraulic head differential throughout the system. Accordingly, a skimmer system is provided for structures having a floor, two side walls and at least one open end, the structure being semi-submersibly positionable in a moving liquid stream. The skimmer system comprises at least one side through having a bottom, an interior through wall and an exterior trough wall. The exterior trough wall is coincident with one side wall of the structure and is provided with at least one opening communicating between the interior of the trough and the exterior of the structure. The interior trough wall is provided with at least one opening communicating between the interior of the trough and the interior of the structure.

The above and other objectives and advantages of the invention will become apparent from the following description when considered with the accompanying drawings.

DESCRIPTION OF PREFERRED EMBODIMENTS OF THE INVENTION

Figure 1:
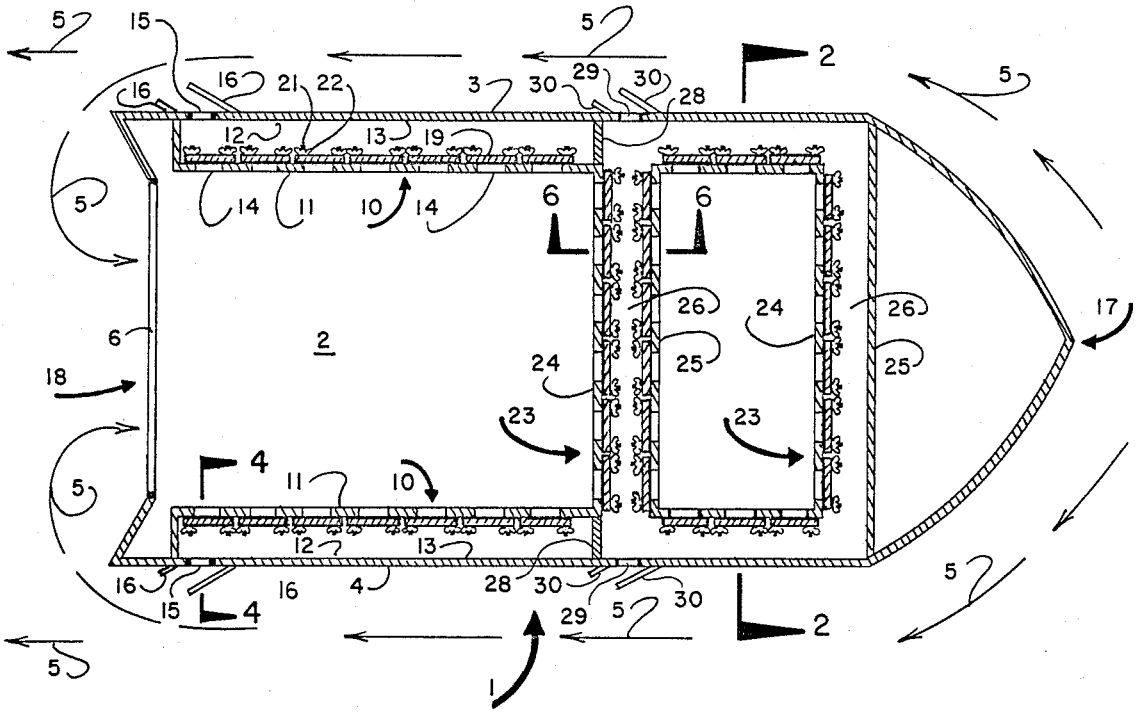
FIG. 1 is a top sectional view of the skimmer system of this invention taken along line 1—1 of FIG. 2.
Figure 2:
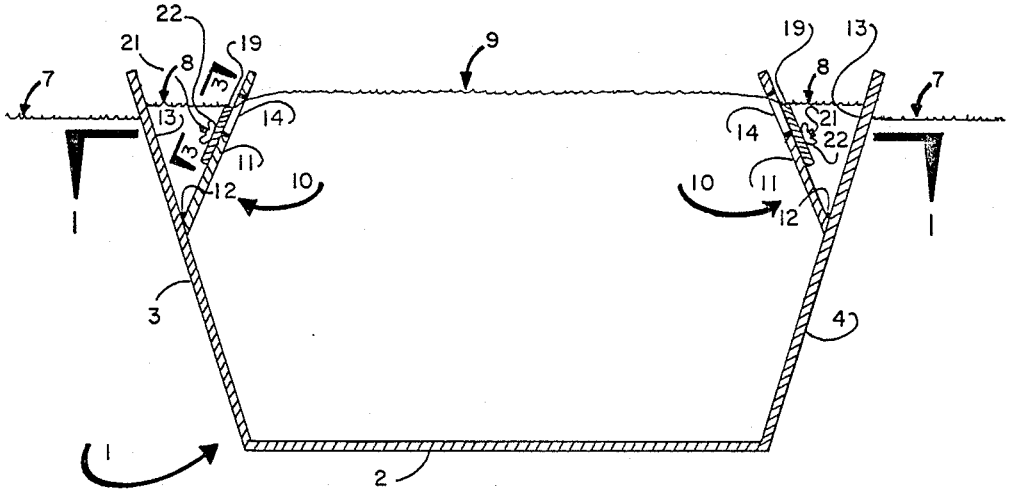
FIG. 2 is a sectional view of the skimmer system of this invention, taken along line 2—2 of FIG. 1.

As shown in FIGS. 1 and 2 the clarifier structure 1 comprises a bottom 2 and side walls 3 and 4. The structure 1 is semi-submersible in a moving stream of liquid, signified by flow arrows 5. The structure is provided with at least one entry opening 6 through which liquid may enter the structure. As shown in FIG. 2, frictional head losses around the exterior of the structure 1 will cause the exterior water level 7 to be slightly lower than the interior water level 9. Head losses caused by any restriction in the channel of the stream of liquid further increase the differential between the exterior water level 7 and interior water level 9. Applicant has taken advantage of this head differential for skimming purposes.

Figure 4:
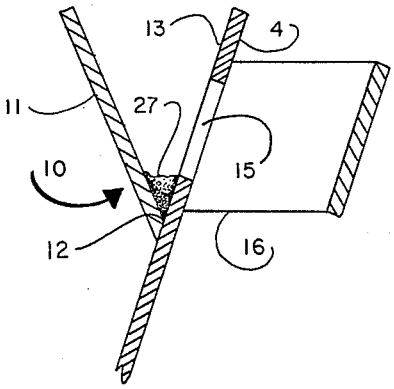
FIG. 4 is a sectional view of an exit opening and vane of this invention, taken along line 4—4 of FIG. 1.
Figure 5:
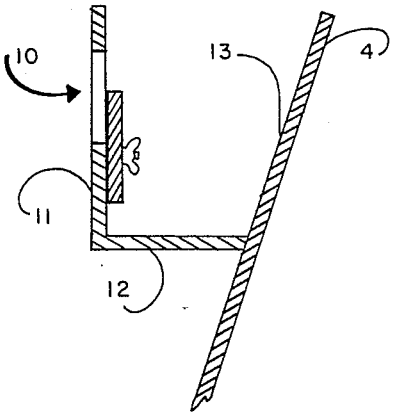
FIG. 5 is a sectional view of an alternate embodiment of the troughs of this invention.

At least one side trough 10 is installed inside the structure 1. The side trough 10 comprises an interior through wall 11, a trough bottom 12 and an exterior trough wall 13. Exterior trough wall 13 may coincide with structure side wall 3, 4 as shown in the Figures. Also, as shown, through bottom 12 may be formed by connecting interior trough wall 11 to a side wall 3,4 in a v-shaped manner. It should be understood that other means of forming trough walls 11 and 13 and bottom 12 may be employed, such as the square-cornered trough shown in FIGS. 5 and 6. As shown in FIG. 4, the v-shaped trough 10 may be given a flat bottom by covering bottom 12 with a filler material 27, such as concrete.

Side troughs 10 are provided with trough entry openings 14 and trough exit openings 15. Trough entry opening 14 is positioned so as to intercept the interior water level 9, allowing surface liquid from inside the structure 1 to flow into trough 10. The skimmed liquid in trough 10 then exits the skimmer system trough exit opening 15. The skimmed liquid may either be removed from the system completely or be returned to the stream flow outside the structure. The latter situation is preferable in sewage applications where the liquid stream outside of the structure is the moving mixed liquor of an oxidation ditch. Trough exit opening 15 should then be positioned so as to intercept exterior water level 7. In this case, a flow is established due to the head differentials between interior water level 9, trough water level 8 and exterior water level 7. In order to aid the establishment of flow through troughs 10, vanes 16 may be added to structure side walls 3, 4. In order to assure that the head differential remains as described above, a dam 28 may be added, along with additional trough exit openings 29 and vanes 30.

Figure 3:
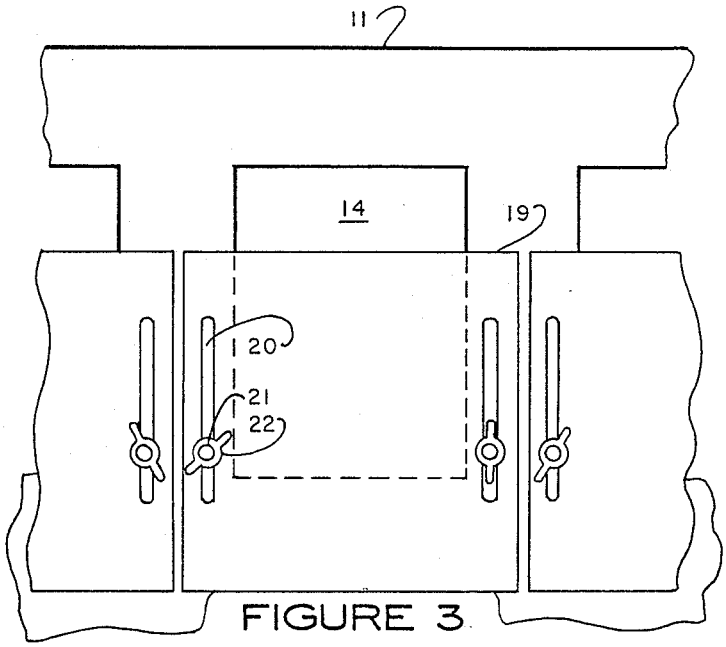
FIG. 3 is a view of the adjustable opening in the trough of this invention, taken along line 3—3 of FIG. 2.

Because of varying flow rates and frictional had losses, the interior water level 9 may vary from the front 17 of the structure 1 toward the rear 18 of the structure 1. Since it is desirable to have multiple trough entry openings 14 to establish a uniform skimming action, it is also desirable to be able to adjust the size of each trough entry opening to compensate for the variance in the interior water level 9. As shown in FIG. 3, this is accomplished by providing an adjustment plate 19 which is slidably positioned over each trough entry opening 14. The adjustment plate 19 may be made adjustable by such means as slots 20 which may be placed over studs 21 and held in place by nuts 22.

Figure 6:
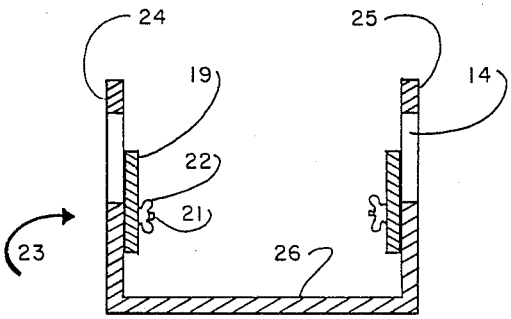
FIG. 6 is a sectional view of an embodiment of a cross trough of this invention, taken along line 6—6 of FIG. 1.

A more uniform skimming action may be established by the addition of cross troughs 23. Cross troughs 23 may be installed transversely across the structure 1. As shown in FIG. 6, the cross trough 23 is constructed similarly to side trough 10, having side walls 24 and 25, and bottom 26. Trough entry openings 14 may be provided on either side of cross trough 23. cross trough 23 may communicate directly with a trough exit opening 15 or 29 or with side troughs 10, as shown in FIG. 1. Of course, cross troughs 23 may also be v-shaped, or take other configurations compatible with the structure 1.

Thus, a skimmer system of interconnected troughs 10, 23 is formed whereby the interior liquid surface is uniformly skimmed of floating matter. The skimmed material may be either removed entirely or returned to the liquid stream exterior of the structure 1. It should be understood that a variety of skimming applications may be accomplished with the skimmer system of this invention including, but not limited to, applications in sewage treatment and oil spill cleanup. These and other variations will occur to those skilled in the art, and are intended to be within the scope and spirit of the following claims.

I claim:

1. In combination with an intrachannel clarifier structure having an interior defined by a floor, two side walls, a front, a rear and at least one entry opening, and said structure being semi-submersibly positioned in a moving liquid stream so as to allow liquid from said stream to assume an interior level within said interior, a skimmer system, comprising at least one side trough having a bottom, an interior trough wall and an exterior trough wall, said exterior trough wall being fixedly connected within said interior of said structure to one of said side walls, said interior trough wall being provided with at least one trough entry opening communicating between said interior of said structure and the interior of said trough at a point so as to intercept said interior level, and said exterior trough wall being provided with at least one trough exit opening communicating between the interior of said side trough and the exterior of said structure so as to intercept the surface of said liquid stream, said skimmer system further comprising at least one adjustment plate, slidingly positionable over at least one said through entry opening.

2. A skimmer system according to claim 1, wherein said interior trough wall is provided with at least one pair of threaded studs, one stud protruding from either side of at least one said trough entry opening, and wherein said adjustment plate is provided with a pair of slots, each said slot being matingly alignable with one said stud, and wherein each said stud is provided with a nut, threadable onto said stud.

3. A skimmer system according to claim 1, wherein one said side trough is provided along each said side wall of said structure.

4. A skimmer system according to claim 3, further comprising at least one cross trough running transversely across said structure, connected to and communicating between said side troughs, said cross trough having a bottom and two side walls.

5. A skimmer system according to claim 4, wherein said cross trough side walls are connected to form a v-shaped bottom.

6. A skimmer system according to claim 4 wherein said cross trough side walls are provided with at least one trough entry opening communicating between said interior of said structure and the interior of said cross trough.

7. In combination with an intrachannel clarifier structure having an interior defined by a floor, two side walls, a front, a rear and at least one entry opening in said front or said rear, and said structure being semi-submersible positioned in a moving liquid stream so as to allow liquid from said stream to assume an interior level within said interior, a skimmer system comprising at least one cross trough, having a bottom and two side walls, running transversely across said structure, at least one said cross trough side wall being provided with at least one trough entry opening communicating between said interior of said structure and the interior of said cross trough, and wherein at least one said side wall of said structure is provided with at least one opening communicating between the interior of said cross trough and the exterior of the structure so as to intercept the surface of said liquid stream , said skimmer system further comprising at least one adjustment plate, slidingly positionable over at least one said through entry opening.

* * * * *